United States Patent [19]

Lidén

[11] Patent Number: 4,498,412

[45] Date of Patent: Feb. 12, 1985

[54] OFFSHORE PLATFORM

[75] Inventor: Hadar Lidén, Västra Frölunda, Sweden

[73] Assignee: Götaverken Arendal AB, Sweden

[21] Appl. No.: 500,308

[22] Filed: Jun. 2, 1983

[30] Foreign Application Priority Data

Jun. 8, 1982 [SE] Sweden ..... 8203536

[51] Int. Cl.[3] ..... B63B 35/44

[52] U.S. Cl. ..... 114/264; 114/265; 114/267; 114/256; 405/207; 405/210

[58] Field of Search ..... 114/264, 265, 266, 267, 114/256, 257, 74; 405/207, 210, 197; 175/5

[56] References Cited

U.S. PATENT DOCUMENTS

| | | | |
|---|---|---|---|
| 3,159,130 | 12/1964 | Vos | 405/210 |
| 3,391,666 | 7/1968 | Schuller | 114/265 |
| 3,490,406 | 1/1970 | O'Reilly | 114/265 |
| 3,824,943 | 7/1974 | Mo | 405/210 |
| 3,921,558 | 11/1975 | Redshaw | 114/256 |
| 3,949,693 | 4/1976 | Bauer | 114/265 |
| 4,059,065 | 11/1977 | Clark | 114/256 |
| 4,232,625 | 11/1980 | Goren | 114/264 |
| 4,356,789 | 11/1982 | Hammett | 114/264 |

FOREIGN PATENT DOCUMENTS

| | | | |
|---|---|---|---|
| 2752151 | 6/1978 | Fed. Rep. of Germany | 114/256 |
| 2727082 | 12/1978 | Fed. Rep. of Germany | 114/256 |

*Primary Examiner*—Trygve M. Blix
*Assistant Examiner*—Patrick Young
*Attorney, Agent, or Firm*—Cantor and Lessler

[57] ABSTRACT

A semi-submersible offshore platform comprises an operating deck carried by four cylindrical columns supported by a pontoon structure comprising four-sided boxes formed into a square ring. Each pontoon box is subdivided into two compartments by a longitudinal centerline bulkhead, the compartments being further subdivided into tanks by transverse bulkheads. Tanks outside the centerline bulkheads are used for ballast water, and tanks inside the centerline bulkheads are used to store the oil produced.

3 Claims, 3 Drawing Figures

OFFSHORE PLATFORM

BACKGROUND OF THE INVENTION

Offshore platforms of the so called semi-submersible type comprise an operating deck carried by columns supported by submersible pontoons. In certain embodiments the operating deck has formed part of a strong box structure enclosing a number of tween decks and integrated with the upper ends of the columns. In this manner a very strong and rigid base structure is obtained, where the need for bracings between the columns is reduced. The braces will offer a certain resistance when the platform is being moved. When the platform is held stationary at the operating field the braces will mean extra surfaces, where waves and currents will impose forces. The points of attachment between the braces and the columns have further shown risks for cracking and fracture.

Semi-submersible platforms used for production, i.e. reception of oil from a previously drilled well, has hitherto lacked storing capacity, so the oil obtained had to be transferred directly to a tanker or to a separate storing facility.

The aim of the present invention is to propose an off-shore platform having an operating deck of sufficient capacity to carry drilling as well as oil recovery equipment, and which is especially strengthened for operation in fields where high service stresses may be encountered The platform furthermore has a significant storing capacity for the oil produced.

SUMMARY OF THE INVENTION

A platform according to the invention has an operating deck carried by four cylindrical columns and is characterized in that the pontoons include four box structures having a substantially four-sided cross-section and formed into a symmetrical, square ring, that each pontoon box structure is subdivided into two compartments by a longitudinal center line bulkhead, that a portion of the outward shell of each column is extended downwardly to form a rounded corner in the square ring, and that the columns lack external interconnection, and that each column is subdivided by cruciform, vertical bulkheads forming extensions of the longitudinal centerline bulkheads in the adjacent pontoon box structures.

Each pontoon box structure is advantageously, in a manner known per se, further subdivided into tanks by means of transverse bulkheads, and the tanks outside the longitudinal bulkheads are connected to pumping means for handling ballast water, while the tanks inside the longitudinal bulkheads are connected to pumping means for handling petroleum products.

A triangular tank structure having substantially the same height as the pontoon box structures is preferably fitted at each inward corner of the square ring structure.

DESCRIPTION OF A PREFERRED EMBODIMENT

Figure 1:
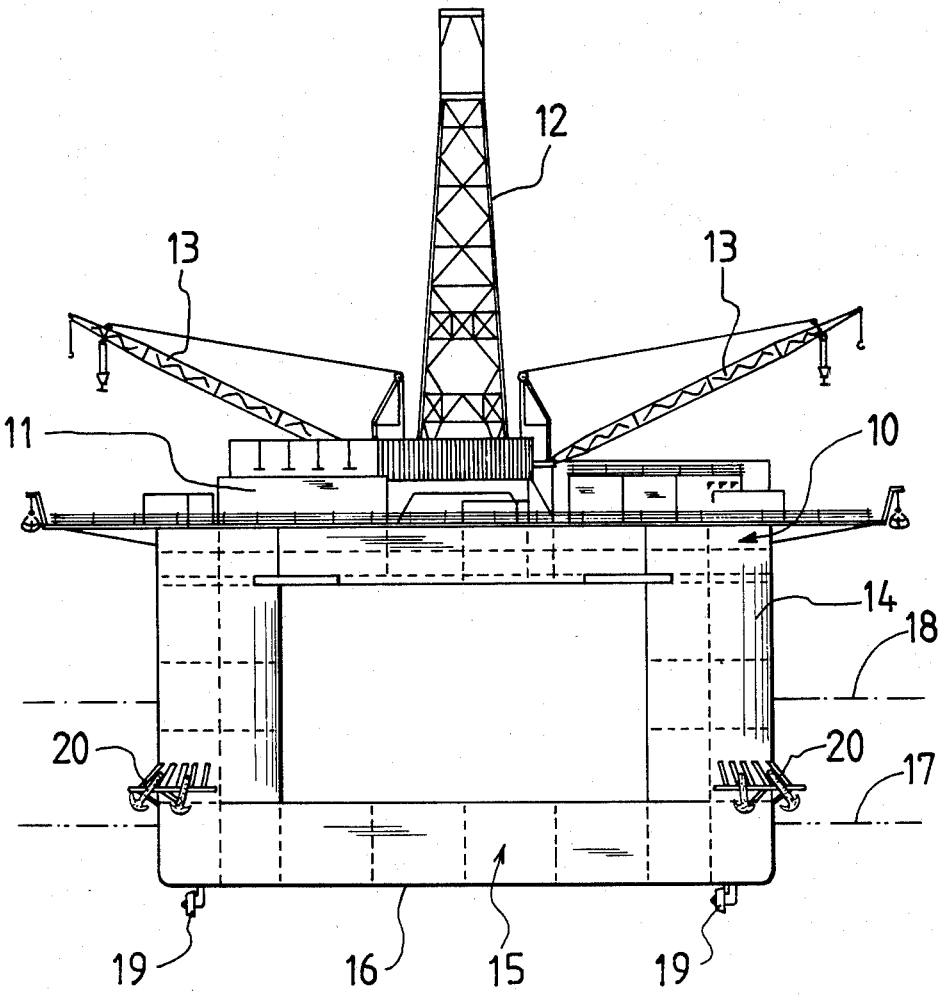
FIG. 1 shows an elevation of a platform according to the invention.
Figure 2:
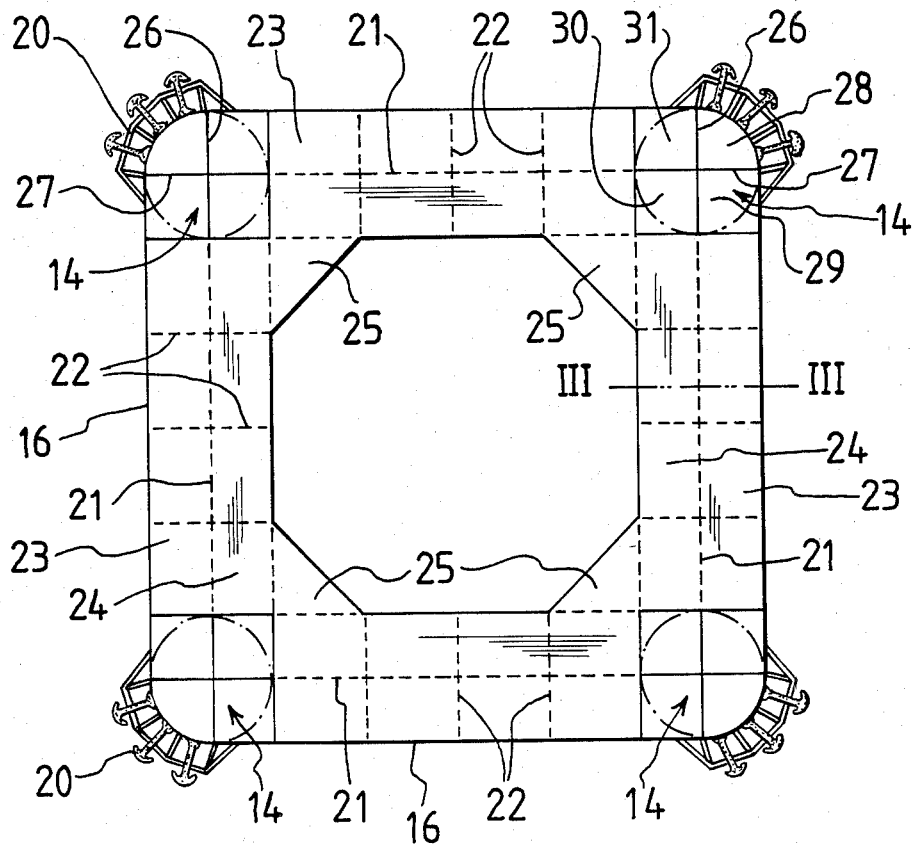
FIG. 2 is a horizontal section through the columns, just above the pontoon boxes.

The offshore platform shown in FIG. 1 is equipped for drilling operations as well as for temporary storing of the oil produced. The platform comprises an operating deck 10, designed as a big box structure and houses, on a number of tween decks, diverse machinery and equipment. On the weather deck there are housings 11 for the crew, housings for further machinery as well as a drilling derrick 12. For handling goods delivered by supply ships there are cranes 13.

Figure 3:
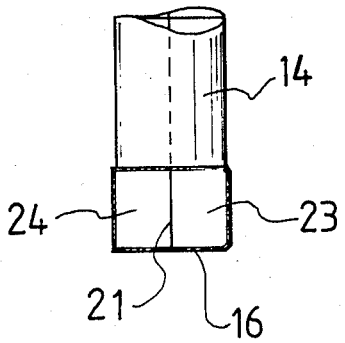
FIG. 3 is a vertical transverse section through one of the pontoon boxes.

The operating deck structure 10 is carried by four cylindrical columns 14, which in turn are supported by a pontoon structure 15 formed as a square ring. This comprises four like box structures 16 having a four-sided cross-section (see FIG. 3). Which are interconnected to a closed unit. The upper operating deck structure 10 and the lower pontoon ring 15 will provide a unique torsional strength in the platform structure, which in this manner can take care of heavy stresses, and also carry all equipment for drilling and handling the products obtained.

The pontoons 16 include in a well known manner ballast tanks, which makes it possible to alter the draft of the platform. The water line during transportation is denoted by 17, and the water line in operating condition is denoted by 18. For moving the platform, and also as an aid for positioning the platform in the field, there is a thruster propeller 19, rotatable 360°, below each column 16. These are further equipped with a number of anchors 20 and associated gear.

Each pontoon box structure 16 is subdivided into two compartments by means of central, longitudinal bulkhead 21. Each compartment is further subdivided into a number of tanks 23, 24 by means of transverse bulkheads 22.

When filled with seawater (WB), the outward tanks 23 have sufficient capacity to ensure that the platform is held at the desired draft (water line 18). The tanks 24 located inside the centerline bulkheads 21, and which are best protected from damages caused by collision with other vessels, or by floatsam, are used to store the oil produced (PO).

Piping and pumping machinery (not shown) make it possible to expel ballast water from tanks 23, as the tanks 24 are filled with oil (and vice versa), so the water line position is maintained.

In each corner of the pontoon ring there is a triangular tank 25, having substantially the same height as the pontoon box structures. These tanks form an important reinforcement of the pontoon ring structure 15, and are preferably used for storing oil.

The cylindrical shell plate in each column 14 is extended downwardly at the adjacent corner of the pontoon ring, which thereby obtains a rounded shape, while at the same time the merging of the columns into the pontoon ring is strengthened.

Each column 14 is divided by cruciform vertical bulkheads 26, 27 subdivided into quadrant-shaped spaces. The bulkheads 26, 27 form extensions of the longitudinal bulkheads 21 in the pontoons 16, which ensures a very strong structure.

Part of the outwardly quadrant space 28 may be used as a chain locker for the mooring anchors 20; one of the spaces, 29, contains machinery for the thruster propeller, one space, 30, houses pumping machinery, and the remaining space, 31, is, as are parts of the spaces 28–30, used for stores of different kinds. There are of course ladders and/or lifts for vertical communication within the columns.

The components forming part of the platform may be varied within the scope of the appended claims, which define a structure which is very safe with respect to strength and stability, even in damaged condition. The design permits easy inspection of the underwater parts, and it is especially suited for use in waters where ice-drift is expected.

What I claim is:

1. An offshore platform of the kind comprising an operating deck carried by four cylindrical columns supported by submerged pontoons, which said pontoons include four box structures having a substantially four-sided cross-section and formed into a symmetrical, square ring where each of said pontoon box structures is subdivided into two compartments by a longitudinal center line bulkhead, and a portion of the outward shell of each column is extended downwardly to form a rounded corner in the square ring, the columns lack external interconnection, and each of said columns is subdivided by cruciform, vertical bulkheads forming extensions of said longitudinal centerline bulkheads in the adjacent pontoon box structures.

2. An offshore platform according to claim 1, in which each of said pontoon box structures is further subdivided into tanks by means of transverse bulkheads, and tanks outside said longitudinal bulkheads are connected to pumping means for handling ballast water, while the tanks inside said longitudinal bulkheads are connected to pumping means for handling petroleum products.

3. An offshore platform according to claim 2, in which a triangular tank structure having substantially the same height as the pontoon box structures is fitted at each inward corner of the square ring structure and is connectable to the petroleum handling means.

* * * * *